US010511152B2

(12) United States Patent
Notarfrancesco et al.

(10) Patent No.: US 10,511,152 B2
(45) Date of Patent: Dec. 17, 2019

(54) METHOD AND SYSTEM FOR A UNIQUE MATERIAL AND GEOMETRY IN A HIGH TEMPERATURE SPARK PLUG EXTENDER

(71) Applicant: Woodward, Inc., Fort Collins, CO (US)

(72) Inventors: Mark Notarfrancesco, Fort Collins, CO (US); Robert Pullaro, Fort Collins, CO (US); Monte Wegner, Bellvue, CO (US)

(73) Assignee: Woodward, Inc., Fort Collins, CO (US)

( * ) Notice: Subject to any disclaimer, the term of this patent is extended or adjusted under 35 U.S.C. 154(b) by 31 days.

(21) Appl. No.: 15/498,312

(22) Filed: Apr. 26, 2017

(65) Prior Publication Data

US 2018/0316161 A1 Nov. 1, 2018

(51) Int. Cl.

| | |
|---|---|
| ***H01T 13/04*** | (2006.01) |
| ***H01T 13/08*** | (2006.01) |
| ***F02P 13/00*** | (2006.01) |
| ***F02P 3/02*** | (2006.01) |

(52) U.S. Cl.

CPC ..... *H01T 13/04* (2013.01); *H01T 13/08* (2013.01); *F02P 3/02* (2013.01); *F02P 13/00* (2013.01)

(58) Field of Classification Search

CPC ..... H01T 13/04; H01T 13/08; F02P 13/00
See application file for complete search history.

(56) References Cited

U.S. PATENT DOCUMENTS

| | | | | |
|---|---|---|---|---|
| 4,715,337 | A * | 12/1987 | Bohl | F02P 13/00 123/169 PA |
| 5,476,695 | A * | 12/1995 | Okada | C08L 81/02 123/169 PA |
| 9,004,929 | B2 * | 4/2015 | Schulze | B29C 45/1671 439/125 |
| 2003/0032339 | A1 * | 2/2003 | Bell | E21B 17/028 439/736 |
| 2003/0038575 | A1 * | 2/2003 | Hori | H01T 13/39 313/141 |

(Continued)

OTHER PUBLICATIONS

SOLVAY: Technical Data Sheet; Xydar G-930 Liquid Crystal Polymer.

(Continued)

*Primary Examiner* — Joseph J Dallo
*Assistant Examiner* — Kurt Philip Liethen
(74) *Attorney, Agent, or Firm* — McAndrews, Held & Malloy

(57) ABSTRACT

Methods and systems for a unique material and geometry in a high temperature spark plug extender and may include a spark plug extender with a conductive core encased in a liquid crystal polymer where opposite ends of the conductive core are not encased in the liquid crystal polymer. A coil may be coupled directly to the spark plug extender. The spark plug extender and the coil may include threads at a first of the opposite ends of the conductive core for the direct coupling of the coil to the spark plug extender. The first of the opposite ends of the conductive core may include an O-ring that provides a seal with the coil. The spark plug extender may include an insulating wire that is coupled to a coil remote from the spark plug extender, the insulating wire extending from an end of the conductive core.

36 Claims, 4 Drawing Sheets

(56) References Cited

U.S. PATENT DOCUMENTS

| | | | | |
|---|---|---|---|---|
| 2004/0194768 | A1* | 10/2004 | Kiker | F02P 3/02<br>123/620 |
| 2005/0202720 | A1* | 9/2005 | Burke | B29C 45/14639<br>439/578 |
| 2010/0319644 | A1* | 12/2010 | Choquette | F02P 3/005<br>123/169 R |
| 2014/0268480 | A1* | 9/2014 | Urciuoli | H01T 19/04<br>361/263 |
| 2014/0328002 | A1* | 11/2014 | Silva | H01T 13/05<br>361/254 |
| 2017/0338589 | A1* | 11/2017 | Marrs | H01R 13/53 |

OTHER PUBLICATIONS

International Search Report and The Written Opinion of the International Searching Authority, of the Declaration for PCT Application No. PCT/US18/23932, International Filing Date Mar. 23, 2018.

* cited by examiner

METHOD AND SYSTEM FOR A UNIQUE MATERIAL AND GEOMETRY IN A HIGH TEMPERATURE SPARK PLUG EXTENDER

PRIORITY CLAIM/INCORPORATION BY REFERENCE

N/A

FIELD

Certain embodiments of the disclosure relate to engine ignition components. More specifically, certain embodiments of the disclosure relate to a method and a system for a unique material and geometry in a high temperature spark plug extender.

BACKGROUND

Existing devices for providing ignition energy to engine spark plugs are costly and suffer from reliability issues in the high temperature and corrosive environment of an engine. Spark plug extenders may be used to provide a signal from a high voltage coil to the spark plug in cases where the engine head is too high for a simple high voltage lead to be coupled directly to the spark plug, as is typical for large industrial machines, for example.

Further limitations and disadvantages of conventional and traditional approaches will become apparent to one of skill in the art, through comparison of such systems with the present disclosure as set forth in the remainder of the present application with reference to the drawings.

BRIEF SUMMARY

A system and/or method is provided for a unique material and geometry in a high temperature spark plug extender, substantially as shown in and/or described in connection with at least one of the figures, as set forth more completely in the claims.

These and various other advantages, aspects and novel features of the present disclosure, as well as details of an illustrated embodiment thereof, will be more fully understood from the following description and drawings.

DETAILED DESCRIPTION

As utilized herein, "and/or" means any one or more of the items in the list joined by "and/or". For example, "x and/or y" means any element of the three-element set {(x), (y), (x, y)}. Similarly, "x, y, and/or z" means any element of the seven-element set {(x), (y), (z), (x, y), (x, z), (y, z), (x, y, z)}. As utilized herein, the term "module" refers to functions than can be implemented in hardware, software, firmware, or any combination of one or more thereof. As utilized herein, the term "exemplary" means serving as a non-limiting example, instance, or illustration.

Figure 1:
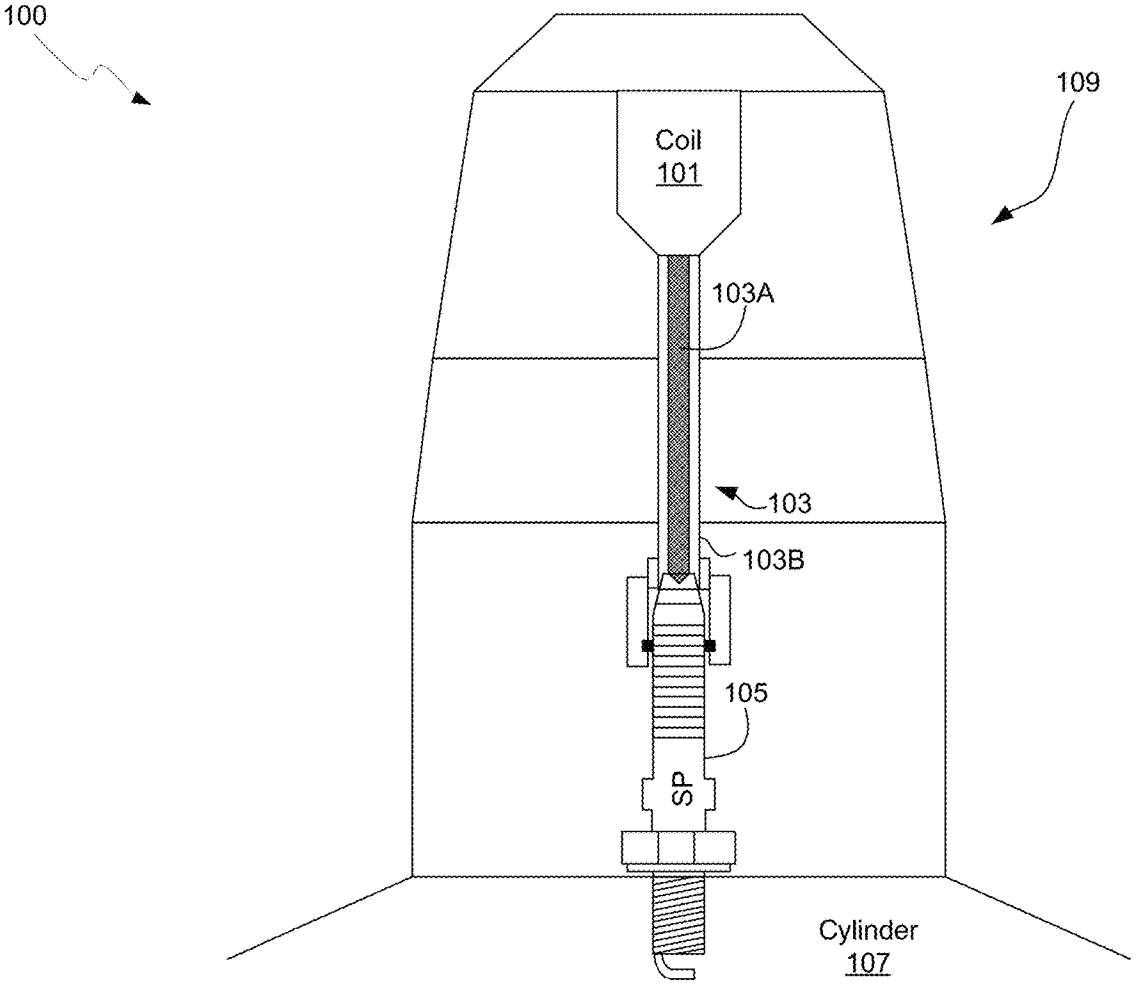
FIG. 1 illustrates a cross-section of an example ignition system for an internal combustion engine, which may be used in accordance with various implementations of the disclosure.

FIG. 1 illustrates a cross-section of an example ignition system for an internal combustion engine, which may be used in accordance with various implementations of the disclosure. Referring to FIG. 1, there is shown ignition system 100 comprising a high voltage ignition coil 101, a spark plug extender 103, a spark plug 105, a cylinder 107, and cylinder head 109. The cylinder head 109 comprises the structure atop the cylinder 107 helping to form the combustion chamber along with the cylinder and piston.

The ignition coil 101 may comprise a primary coil, a secondary coil, and a core, with the number of turns for the primary and secondary coils configured to convert a low voltage to a high voltage, e.g., thousands of volts, needed for generating a spark in the spark plug 105. In the example shown in FIG. 1, the ignition coil 101 is within the cylinder head 109, minimizing the distances high voltage signals need to be transmitted, while other designs may have the coil external to the cylinder head 109 with high voltage lines coupling the remote coil to the spark plug extender 103.

The spark plug extender 103 comprises an insulator 103B surrounding a conductive central path, e.g. high voltage conductive rod 103A, for providing high voltage to the spark plug 105. For large bore engines, delivering ignition energy to the high voltage terminal of the spark plug 105 requires a rigid, easily accessible insulated conductor that can withstand significant heat while retaining dielectric strength. It is desirable to have a cost effective, rigid insulation capable of delivering high voltage pulses to the spark plug 105 to enable sparking in environments up to and exceeding 200° C. In addition, the spark plug extender 103 should be mechanically and electrically durable due to the vibration, temperature, and chemical aspects of the engine environment. One or more O-rings may be incorporated in the spark plug extender 103 for making a sealed connection to the spark plug 105 and/or the coil 101.

A performance parameter for spark plug extenders is the amount of voltage delivered to the spark plug at elevated temperatures. A simulated engine environment may be utilized to measure the voltage delivered to a spark plug at varying temperatures. In addition, the ability to retain proper dielectric properties such that the extender is able to deliver the high voltage signal over many hours of use, is an important parameter for spark plug extenders.

Typical materials used in spark plug extenders comprise polyimide based plastics. However, the dielectric strength of these materials degrades over time and also with increased temperature, reducing their insulating properties significantly. In an example scenario, a liquid crystal polymer may be used to form the spark plug extender 103. In an example embodiment, the liquid crystal polymer comprises an injection moldable liquid crystal polymer. The fully aromatic structure of a liquid crystal polymer provides fewer charge carriers as compared to the C=O bonds of polyimides. Furthermore, glass reinforcement of the liquid crystal polymer provides excellent dielectric performance even in harsh engine environments. The dielectric strength of the material is important, as this factor determines the maximum open circuit voltage the insulator can handle before breaking down. In addition, it has been shown that the disclosed spark plug extender comprising a liquid crystal polymer has improved dielectric strength with temperature and has excellent resistance to corrosion and wear.

An example injection moldable liquid crystal polymer is Xydar, which is a glass reinforced injection moldable polymer and exhibits good chemical resistance, moldability, and high stiffness. The resistivity of this material is typically $1\times10^{16}$ Ω-cm with a dielectric strength of 39 kV/mm.

Further, utilizing a liquid crystal polymer for forming a spark plug extender enables the use of injection molding, whereby the spark plug extender 103 may be formed by injecting liquid crystal polymer into a mold structure with the liquid crystal polymer surrounding a high voltage rod, which solidifies into a solid extender part, thereby enabling cost effective manufacturing. The resulting structure retains its dielectric capabilities at high temperatures, and even exhibits increased dielectric strength with temperature. An example of an injection moldable liquid crystal polymer is a glass reinforced heat stabilized polyphthalamide, which exhibits high heat deflection temperature, high flexural modulus, low moisture absorption, and high tensile strength.

Figure 2:
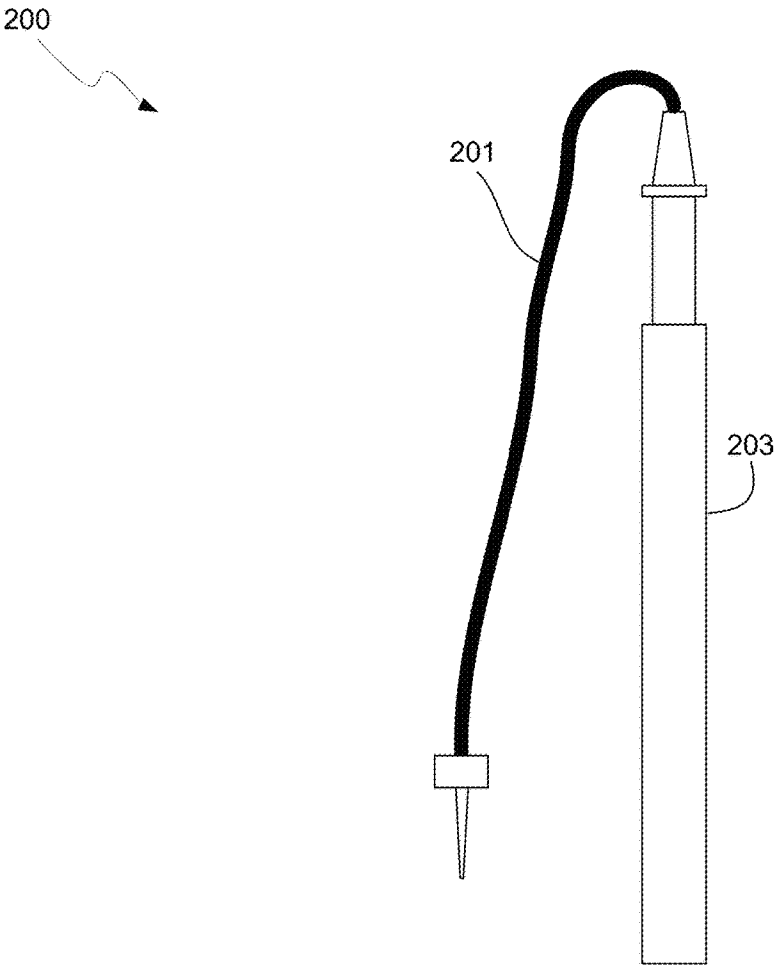
FIG. 2 illustrates a high voltage lead, in accordance with an example embodiment of the disclosure.

FIG. 2 illustrates a high voltage lead, in accordance with another example embodiment of the disclosure. Referring to FIG. 2, there is shown lead 200 comprising an insulated wire 201 and an extender 203. The lead 200 may be used in conjunction with a remote coil as opposed to one being mounted on the extender, as shown with coil 101 in FIG. 1 being mounted directly on spark plug extender 103. The extender 203 may comprise a high voltage conducting rod within a dielectric material for providing high voltage to a spark plug without shorting to adjacent conductive structures. By utilizing a remote coil, high voltages are present along both the insulated wire 201 and the extender 203.

In an example scenario, the extender 203 may comprise an injection molded liquid crystal polymer to enable high temperature dielectric capability in harsh engine environments. Mounting one or more coils remotely may provide advantages such as ease of maintenance or a reduced required number of coils without the need of a coil at each spark plug. In another example scenario, the extender 203 may comprise insulated wire within the liquid crystal polymer as well as wire extending to a remote coil.

Figure 3:
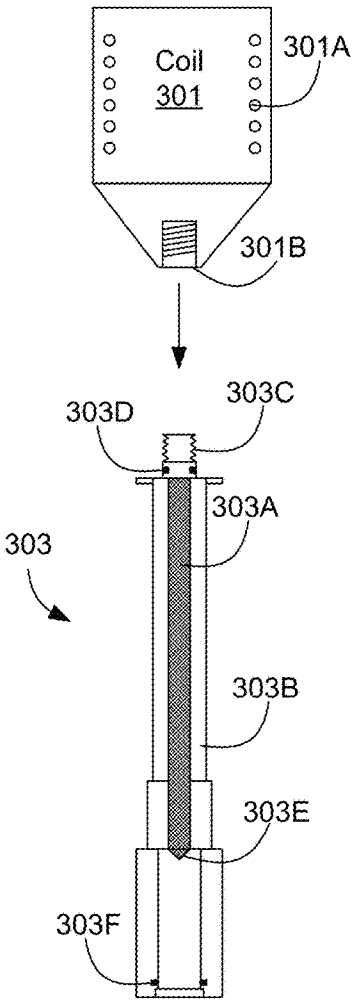
FIG. 3 illustrates an example spark plug extender with a mounted coil, in accordance with an example embodiment of the disclosure.

FIG. 3 illustrates an example spark plug extender with a mounted coil, in accordance with an example embodiment of the disclosure. Referring to FIG. 3, there is shown a coil 301 and a spark plug extender 303, with the extender and coil shown in cross-sectional view to illustrate internal components such as a conductive core 303A within an insulator 303B that surrounds the rod.

The coil 301 may be substantially similar to the coil 101 described with respect to FIG. 1, and may be coupled directly to the spark plug extender 303, as opposed to being coupled to a remote coil, as with the high voltage lead in FIG. 2. Coupling directly to the extender reduces the distance that high voltages must be carried, reducing the length of high voltage compatible materials needed for insulation.

The coil may comprise pairs of coiled conductors 301A wrapped around a core (not shown), the coils comprising primary and secondary windings for receiving an input voltage and generating a high voltage output that is high enough voltage to generate a spark at an attached spark plug. In addition, the coil 301 may comprise threads 301B for coupling to the spark plug extender 303.

The spark plug extender 303 comprises an internal high voltage conductive core 303A which is embedded within insulator 303B. The conductive core 303A comprises a conductive material, such as a metal, that can withstand the high temperature and corrosive (at exposed ends, for example) environment of an engine compartment. In another example scenario, the conductive core 303A may comprise an insulated wire within the insulator 303B. The conductive core 303A may comprise a tapered end 303E that may be utilized for making contact to a spark plug coupled to the extender 303. The tapered end 303E may comprise a tapered spring or coil for providing a force against the spark plug, although the disclosure is not so limited, as other structures may be utilized to make contact with the spark plug, such as a solid tapered tip, for example.

The insulator 303B comprise an insulating material that can provide electrical isolation for the high voltages provided by the conductive core 303A. In addition, the insulator 303B should be able to withstand a corrosive environment and stay structurally and electrically intact when subjected to intense vibrations often encountered in the engine. In an example scenario, the insulator 303B comprise a liquid crystal polymer, such as a glass reinforced heat stabilized polyphthalamide. Using a liquid crystal polymer enables injection molding of the spark plug extender 303. The ends of the conductive core 303A may be exposed, i.e., not covered by the insulator 303B, so that the ends may provide electrical contact to the coil 301 and a spark plug, such as the spark plug 105 shown in FIG. 1.

In addition, the spark plug extender 303 may comprise a threaded portion 303C for coupling to the coil threads 301B of the coil 301, and a seal 303D for providing a relatively sealed environment within the coil 301 when attached to the spark plug extender 303, protecting the electrical connection from the corrosive environment of the engine compartment. The seal 303D may comprise an O-ring, grommet, gasket, a combination thereof, or other type of sealing mechanism. While the example coil/extender connector shown in FIG. 3 utilizes external threads on the extender 303 and internal threads on the coil 301, this may be reversed with a collar on the extender 303 with internal threads and an extension on the coil 301 with external threads.

In an example scenario, a liquid crystal polymer may be used to form the spark plug extender 303. The fully aromatic structure of a liquid crystal polymer provides fewer charge carriers as compared to the C═O bonds of polyimides. Furthermore, glass reinforcement of the liquid crystal polymer provides excellent dielectric performance even in harsh engine environments. The dielectric strength of the material is important, as this factor determines the maximum open circuit voltage the insulator can handle before breaking down. Liquid crystal polymers have demonstrated dielectric strengths of approximately 40 kv/mm, a value that is higher than that of cost-effective materials previously used for spark plug extenders. In addition, it has been shown that the spark plug extender has improved dielectric properties with temperature and has excellent resistance to corrosion. For example, liquid crystal polymer spark plug extenders installed in an engine with a leaky spark plug gasket caused residue to form on the outside of the spark plug extenders but did not cause any dielectric breakdown or increased voltage loss to the spark plug terminal.

An example liquid crystal polymer used to fabricate the spark plug extender 103 resulted in four times improvement in voltage provided to the spark plug as compared to a standard material used in this application, such as polyimide based plastics. In another example scenario, the liquid crystal polymer may be machined to form the finished extender as opposed to injection molding.

Figure 4:
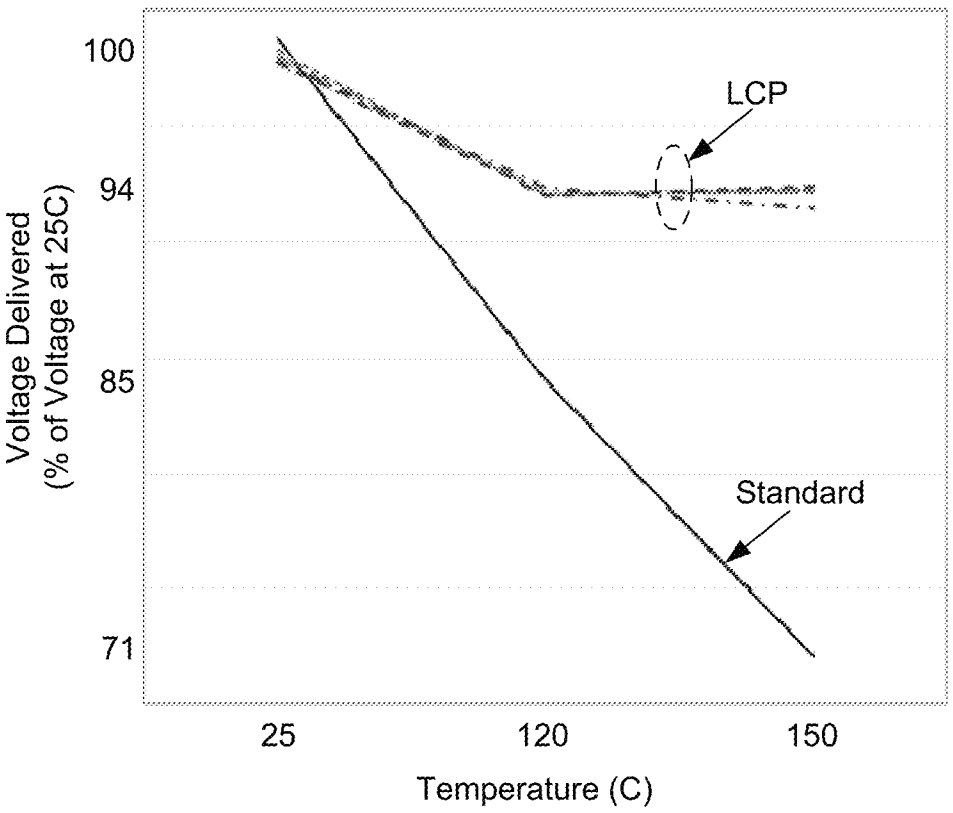
FIG. 4 illustrates a plot of voltage delivered versus temperature for spark plug extenders, in accordance with an example embodiment of the disclosure.

FIG. 4 illustrates a plot of voltage delivered versus temperature for spark plug extenders, in accordance with an example embodiment of the disclosure. Referring to FIG. 4, there is shown a plot of voltage supplied to a spark plug for five spark plug extenders comprising liquid crystal polymer as well as an extender of conventional material, e.g., polyimide, in a simulated engine environment. Voltage loss, or a drop in supplied voltage as temperature increases, is a measure of a material's dielectric strength. For example, a high dielectric strength material will have low voltage loss and continue to provide a high voltage as temperature increases, and a low dielectric strength material would exhibit higher voltage loss, with a lower voltage supplied to the spark plug at higher temperatures.

In assessing the performance of liquid crystal polymer spark plug extenders, voltage loss tests were performed, where measurements were made at 25 C (room temperature), 120 C, and 150 C. FIG. 4 illustrates delivered voltage measured for 5 different liquid crystal polymer spark plug extenders as compared to a conventional material extender.

As shown in FIG. 4, the voltage drop is not significant for the liquid crystal polymer devices as the temperature increases from 25 C to 120 C, but is rather significant for the conventional device. In addition, the supplied voltage, i.e. the voltage supplied by the spark plug extender, actually increases for most of the tested liquid crystal polymer devices from 120 C to 150 C, which is a significant improvement over conventional devices, which lose significant voltage in this temperature range.

Certain aspects of the disclosure may be found in a method and system for a unique material and geometry in a high temperature spark plug extender. Exemplary aspects of the disclosure may comprise a spark plug extender comprising a conductive core encased in a liquid crystal polymer with opposite ends of the conductive core not encased in the liquid crystal polymer. A coil may be coupled directly to said spark plug extender. The spark plug extender and the coil comprise threads, with the spark plug extender comprising threads at a first of the opposite ends of the conductive core for the direct coupling of the coil to the spark plug extender.

The first of the opposite ends of the conductive core comprises one or more of: an O-ring, grommet, and gasket that provide a seal with the coil. The spark plug extender may comprise an insulating wire that is coupled to a coil remote from the spark plug extender, the insulating wire extending from an end of the conductive core. The conductive core may comprise a tapered end at one of the opposite ends for making electrical contact with a spark plug coupled to the spark plug extender. The tapered end may comprise a spring. A portion of the liquid crystal polymer may extend beyond a second of the opposite ends of the conductive core for enclosing a portion of a spark plug coupled to the spark plug extender.

The portion of the injection liquid crystal polymer that extends beyond a second of the opposite ends of the conductive core may comprise an O-ring that provides a seal to the spark plug. The liquid crystal polymer may exhibit increased dielectric strength with increased temperature at engine operating temperatures.

The spark plug extender may exhibit reduced voltage drop with increased temperature at engine operating temperatures. The liquid crystal polymer may comprises an injection molded liquid crystal polymer. The injection molded liquid crystal polymer may comprise Xydar. The conductive core may comprise an insulated metal wire. The liquid crystal polymer may comprise glass reinforcement. The spark plug extender may comprise machined liquid crystal polymer.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A system for engine ignition, the system comprising:

a spark plug extender for coupling a voltage to a spark plug, the spark plug extender comprising a conductive core encased in a liquid crystal polymer with opposite ends of said conductive core not encased in said liquid crystal polymer, wherein the voltage delivered to the spark plug increases as temperature of the spark plug extender increases above 120 degrees C.

2. The system according to claim 1, wherein a coil is coupled directly to said spark plug extender.

3. The system according to claim 2, wherein said spark plug extender and said coil comprise threads, said spark plug extender comprising threads at a first of said opposite ends of said conductive core for said direct coupling of said coil to said spark plug extender.

4. The system according to claim 3, wherein said first of said opposite ends of said conductive core comprises one or more of: an O-ring, grommet, and gasket that provide a seal with said coil.

5. The system according to claim 1, wherein said spark plug extender comprises an insulating wire that is coupled to a coil remote from said spark plug extender, said insulating wire extending from an end of said conductive core.

6. The system according to claim 1, wherein said conductive core comprises a tapered end at one of said opposite ends for making electrical contact with a spark plug coupled to said spark plug extender.

7. The system according to claim 6, wherein said tapered end comprises a spring.

8. The system according to claim 1, wherein a portion of said liquid crystal polymer extends beyond a second of said opposite ends of said conductive core for enclosing a portion of a spark plug coupled to said spark plug extender.

9. The system according to claim 8, wherein said portion of said injection liquid crystal polymer that extends beyond a second of said opposite ends of said conductive core comprises an O-ring that provides a seal to said spark plug.

10. The system according to claim 1, wherein said liquid crystal polymer exhibits increased dielectric strength with increased temperature at engine operating temperatures.

11. The system according to claim 1, wherein said spark plug extender exhibits reduced voltage drop with increased temperature at engine operating temperatures.

12. The system according to claim 1, wherein said liquid crystal polymer comprises an injection moldable liquid crystal polymer.

13. The system according to claim 12, wherein said injection molded liquid crystal polymer comprises Xydar.

14. The system according to claim 1, wherein said conductive core comprises an insulated metal wire.

15. The system according to claim 1, wherein said liquid crystal polymer comprises glass reinforcement.

16. The system according to claim 1, wherein said spark plug extender comprises machined liquid crystal polymer.

17. A method for engine ignition, the method comprising:

in a spark plug extender for coupling a voltage to a spark plug, the spark plug extender comprising a conductive core encased in a liquid crystal polymer with opposite ends of said conductive core not encased in said liquid crystal polymer:

receiving a high voltage electrical signal at a first of said opposite ends of said conductive core; and communicating said high voltage electrical signal to a second of said opposite ends of said conductive core wherein the voltage delivered to the spark plug increases as temperature of the spark plug extender increases above 120 degrees C.

18. The method according to claim 17, comprising coupling a coil directly to said spark plug extender.

19. The method according to claim 18, wherein said spark plug extender and said coil comprise threads, said spark plug extender comprising threads at a first of said opposite ends of said conductive core for said direct coupling of said coil to said spark plug extender.

20. The method according to claim 18, wherein said first of said opposite ends of said conductive core comprises one or more of: an O-ring, grommet, and gasket that provide a seal with said coil.

21. The method according to claim 17, wherein said spark plug extender comprises an insulating wire that is operable to couple to a coil remote from said spark plug extender, said insulating wire extending from an end of said conductive core.

22. The method according to claim 17, wherein said conductive core comprises a tapered end at one of said opposite ends for making electrical contact with a spark plug coupled to said spark plug extender.

23. The method according to claim 22, wherein the tapered end comprises a spring.

24. The method according to claim 17, wherein a portion of said liquid crystal polymer extends beyond a second of said opposite ends of said conductive core for enclosing a portion of a spark plug coupled to said spark plug extender.

25. The method according to claim 24, wherein said portion of said liquid crystal polymer that extends beyond a second of said opposite ends of said conductive core comprises one or more of: an O-ring, grommet, and gasket that provide a seal to said spark plug.

26. The method according to claim 17, wherein said spark plug extender exhibits reduced voltage drop with increased temperature at engine operating temperatures.

27. The method according to claim 17, wherein said liquid crystal polymer comprises injection moldable liquid crystal polymer.

28. The method according to claim 27, wherein said injection molded liquid crystal polymer comprises Xydar.

29. The method according to claim 17, wherein said conductive core comprises an insulated metal wire.

30. The method according to claim 27, wherein said injection molded liquid crystal polymer comprises glass reinforcement.

31. The method according to claim 30, wherein said spark plug extender comprises machined liquid crystal polymer.

32. A system for engine ignition, the system comprising:

a spark plug extender for coupling a voltage to a spark plug, the spark plug extender comprising a conductive core encased in a liquid crystal polymer with opposite ends of said conductive core not encased in said liquid crystal polymer, wherein a first of said opposite ends is operable to make electrical contact to a coil, a second of said opposite ends is operable to make electrical contact to a spark plug, and the voltage delivered to the spark plug increases as temperature of the spark plug extender increases above 120 degrees C.

33. The system according to claim 32, wherein said spark plug extender exhibits reduced voltage drop with increased temperature at engine operating temperatures.

34. The system according to claim 32, wherein said liquid crystal polymer comprises an injection molded liquid crystal polymer.

35. The system according to claim 34, wherein said injection molded liquid crystal polymer comprises Xydar.

36. The system according to claim 32, wherein said liquid crystal polymer comprises glass reinforcement.

* * * * *